US007168358B2

(12) United States Patent
Hosoe et al.

(10) Patent No.: US 7,168,358 B2
(45) Date of Patent: Jan. 30, 2007

(54) STATIC PRESSURE SLIDING BLOCK

(75) Inventors: Shigeru Hosoe, Hachioji (JP); Hiroyuki Matsuda, Sagamihara (JP)

(73) Assignee: Konica Minolta Opto, Inc. (JP)

( * ) Notice: Subject to any disclaimer, the term of this patent is extended or adjusted under 35 U.S.C. 154(b) by 16 days.

(21) Appl. No.: 11/175,828

(22) Filed: Jul. 6, 2005

(65) Prior Publication Data

US 2006/0013696 A1 Jan. 19, 2006

(30) Foreign Application Priority Data

Jul. 13, 2004 (JP) ..... 2004-206274

(51) Int. Cl.
*F16C 32/06* (2006.01)
*B65G 7/06* (2006.01)

(52) U.S. Cl. ..... 91/46; 384/12

(58) Field of Classification Search ..... 91/6, 91/46; 184/100; 384/12
See application file for complete search history.

(56) References Cited

U.S. PATENT DOCUMENTS

| | | | | |
|---|---|---|---|---|
| 4,865,465 | A * | 9/1989 | Sugita et al. | 384/12 |
| 5,562,395 | A * | 10/1996 | Yamazaki et al. | 384/12 |
| 6,315,449 | B1 * | 11/2001 | Mueller | 384/12 |
| 6,502,987 | B2 * | 1/2003 | Kafai | 384/12 |
| 7,093,979 | B2 * | 8/2006 | Sawada et al. | 384/12 |

* cited by examiner

*Primary Examiner*—Thomas E. Lazo
(74) *Attorney, Agent, or Firm*—Cantor Colburn LLP

(57) ABSTRACT

A static pressure sliding block which can exhibit a stable function for a long time while flow control member 23 is pressed onto recess surface 21*b* of static pressure receiving surface 21*a* for fixing it onto main body 21 formed of a brittle material by employing elastic deformation of connecting member 22 so that damage of main body 21 can be avoided because flow control member 23 is fixed without screw holes and only by applying compression stress.

15 Claims, 7 Drawing Sheets

FIG. 6 ( a )
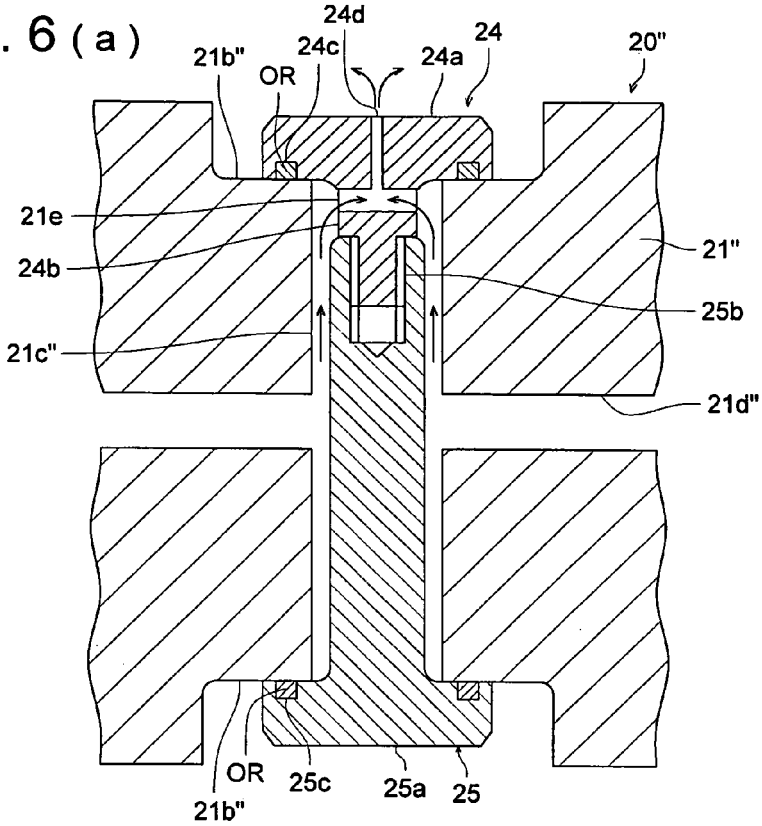
FIG. 6 ( b )
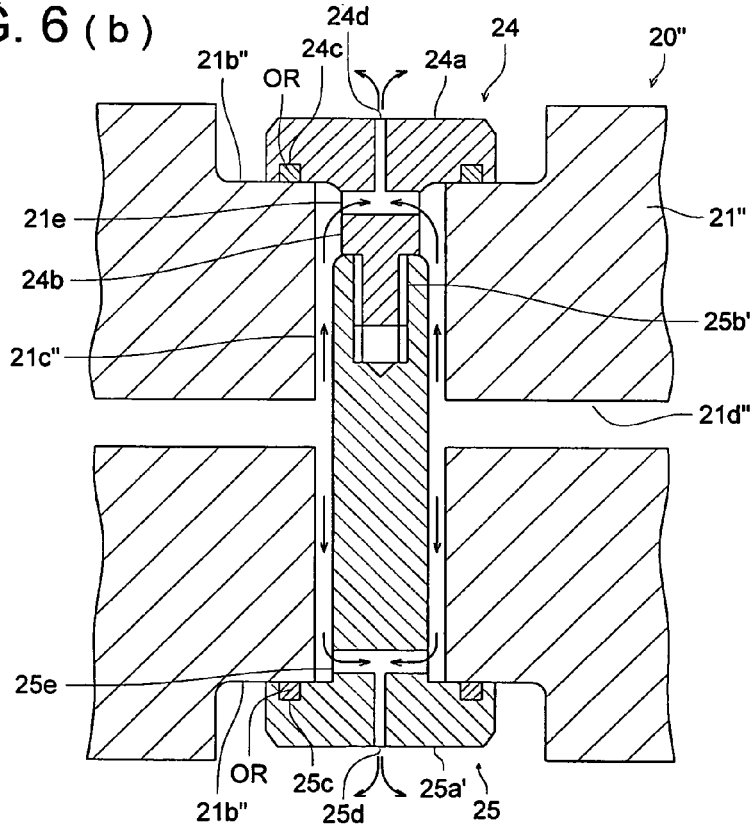

FIG. 6 ( c )
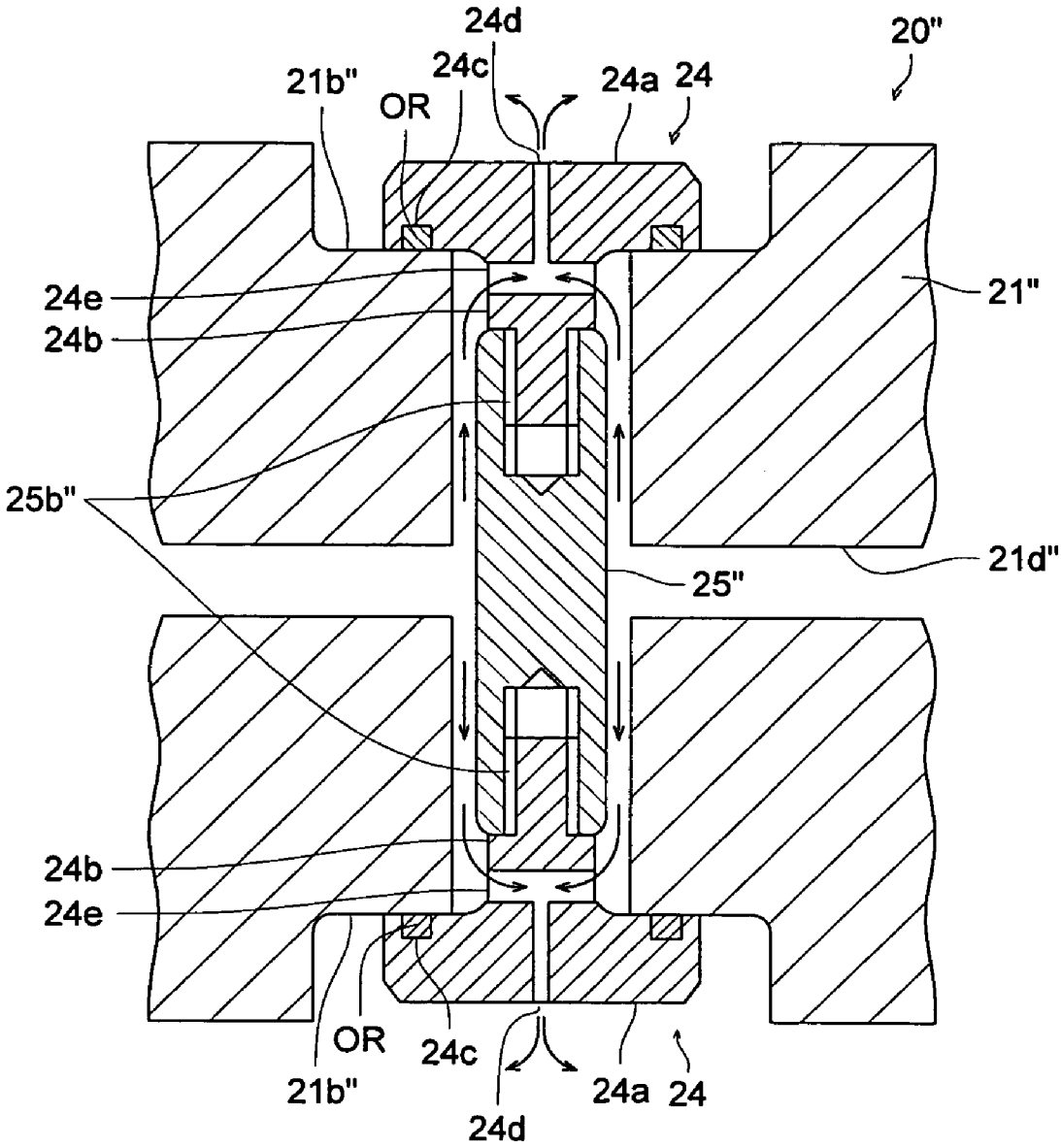

STATIC PRESSURE SLIDING BLOCK

This application is based on Japanese Patent Application No. 2004-206274 filed on Jul. 13, 2004 in Japanese Patent Office, the entire content of which is hereby incorporated by reference.

BACKGROUND OF THE INVENTION

The present invention relates to a static pressure sliding block, particularly to a static pressure sliding block supported movably using a pressure transmission medium.

A processing machine is known in the prior art to cut, grind and otherwise an optical device and molding die (Patent Document 1). Such a machine is provided with a static pressure sliding block to ensure high-precision traveling of the workbench.

[Patent Document 1] Tokkai No. 2003-39294

To more precisely generate the complicated curved surface corresponding to the aspherical surface of an optical device, it is important to meet the following requirements more sufficiently than the prior art machine.

[Requirements for Higher Precision]

(1) To improve the control precision of a machine, it is important to improve the resolution for position measurement of each axis, and to provide high-precision control of a workbench (slide table or turn table) driven by a high-speed servo mechanism. Further, to ensure quick response to the drive command of the servomotor, it is important to use a low-density material to reduce the weight of the static pressure sliding block being driven. (2) Since each axis is designed in a two- or three-stage building block structure, structural rigidity tends to be reduced. To avoid this, it is necessary to increase the rigidity of each axis and to raise the supporting rigidity of the pressure transmission medium for this purpose. Further, it is important to use material having a higher Young's modulus. (3) It is very important to provide resistance to changes in ambient temperature. When a static pressure sliding block is utilized, it is important to improve the supporting rigidity of the pressure transmission medium and to ensure that each member is made of material having a small linear expansion coefficient to avoid useless heat generation. (4) It is important to ensure that processing is terminated before a large ambient change occurs, and to reduce the machining time in order to achieve highly efficient machining. To achieve high-speed driving of the axis, it is important to increase the speed of the servomechanism so as to conform to high resolution for position measurement. In order to avoid deterioration of the rigidity in the static pressure receiving surface or to prevent vibration, it is important to improve the supporting rigidity of the pressure transmission medium.

To reduce the weight of the static pressure sliding block, ceramic can be employed instead of metal used as a material. In the meantime, to enhance supporting rigidity of the pressure transmission medium, oil can be used instead of a gas. However, if the static pressure sliding block is made of metal, a tapped hole can be formed in the static pressure receiving surface by tapping operation, and an orifice member for adequate discharge of the pressure transmission medium can be screwed directly into the tapped hole. By contrast, when the static pressure sliding block is made of ceramic, it is difficult to form a tapped hole, and may be damaged because of its brittleness when the orifice member is screwed into the hole even if the hole could be tapped. To solve this problem, an adhesive is used to secure the orifice member on the ceramic static pressure sliding block. However, when oil is used as a pressure transmission medium, the adhesive may dissolve or be denatured, and adhesive force may be deteriorated, resulting in the orifice member being disengaged.

SUMMARY OF THE INVENTION

The above problems can be solved by the following configuration.

A sliding block supported movably by static pressure of a pressure transmission medium between a pair of supporting surfaces comprising: a block body comprising a first traveling surface and a second traveling surface each opposed to the supporting surfaces to travel, a first opening and a second opening formed on the first traveling surface and the second traveling surface respectively, a penetrating hole which is smaller than the first opening and the second opening, and communicates with respective bottom surfaces of the first opening and the second opening, and a first overhanging member and a second overhanging member which are located in the first opening and the second opening respectively and each has a overhanging portion larger than the penetrating hole; a connecting member located in the penetrating hole, to connect the first overhanging member and the second overhanging member; wherein at least one of the first overhanging member and the second overhanging member has a coupling mechanism to be detachable from the connecting member, and the first overhanging member and the second overhanging member are fixed while pressing the bottom surfaces of the first opening and the second opening respectively through the connecting member by means of the coupling mechanism; and a flow control portion provided to at least one of the first overhanging member and the second overhanging member, to discharge the pressure transmission medium supplied into the penetrating hole and to control a flow rate of the pressure transmission medium.

BRIEF DESCRIPTION OF THE DRAWINGS

FIG. 6(*a*) is a modified example of the assembly structure of the flow control member and connecting member in which one flow control member is installed on one end of a connecting member which is formed of a solid shaft.

FIG. 6(*b*) is a modified example of a solid shaft with flow control members on both sides in which one flow control member is integrated with the solid shaft as one piece.

FIG. 6(*c*) is a modified example of a solid shaft with flow control members on both sides in which both the flow control members are screwed into the solid shaft.

DETAILED DESCRIPTION OF THE PREFERRED EMBODIMENT

Figure 1:
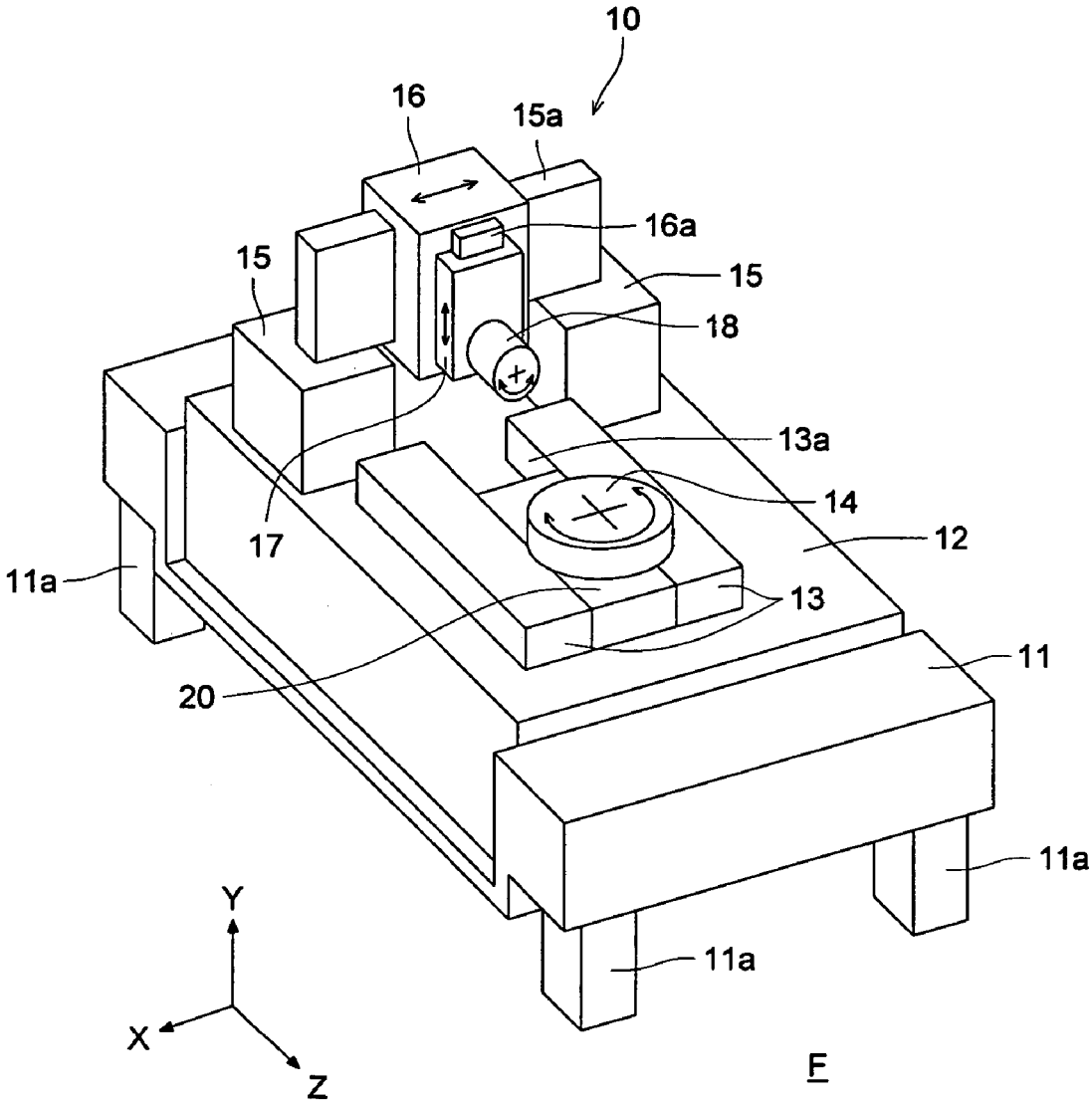
FIG. 1 is a perspective view of 5-axis machine 10 equipped with a static pressure sliding block of the present invention.

In view of the prior art described above, it is an object of the present invention to provide a static pressure sliding block (sliding block) characterized by light weight and a high degree of rigidity and reliability.

The static pressure sliding block (sliding block) of the present invention is one supported movably by a pressure transmission medium against supporting surfaces and is composed of a sliding block body formed of brittle material communicating with a pair of static pressure receiving surfaces as the traveling surfaces opposed to the supporting surface through an aperture as the penetrating hole, a flow control member equipped with a flow controlling portion as the overhanging member which supplies the pressure transmission medium to the space between the supporting surfaces and static pressure receiving surfaces, a flow rate controlled pressure transmission medium and a connecting member made of elastic material, connected to the flow control member, extending from one of the static pressure receiving surfaces to the other static pressure receiving surface through the above aperture, and mounted on the other static pressure receiving surface; wherein the flow control member is pressed against one of the static pressure receiving surfaces by the elastic deformation of the connecting member. In the present specification, the brittle material refers to a material whose fracture toughness value does not exceed 10 $MN/m^{3/2}$ (e.g. ceramic). "Elastic material" refers to a material wherein distortion occurs in response to the internal stress within a predetermined value and said distortion disappears if there is no internal stress. The connecting member need not be a member separate from the flow control member and can be made a part or the whole of the flow control member.

Brittle material such as ceramic generally tends to be weak under tensile stress but strong under compressive stress. In the present invention, the flow control member is pressed against one of the static pressure receiving surfaces by the elastic deformation of the connecting member, and the flow control member is mounted on the sliding block body formed of brittle material while only compressive stress is applied. This arrangement does not require use of a tapped hole, and eliminates the possibility of damaging the sliding block body. This ensures stable functioning of the static pressure sliding block for a long period of time.

The static pressure sliding block of the present invention is further characterized in that the aforementioned connecting member is a pipe, and the aforementioned flow control members are mounted on both ends thereof. This structure allows the interior of this pipe to be used as a passage for the pressure transmission medium.

The static pressure sliding block is further characterized in that the aforementioned pressure transmission medium is supplied through the aforementioned aperture. Thus, while the pressure transmission medium passes through the aperture, heat exchange is carried out between the pressure transmission medium and the wall surface thereof, whereby the temperature of the sliding block body can be controlled. This arrangement reduces thermal expansion and shrinkage of the sliding block body, and prevents the positions of the sliding block body, a tool and spindle mounted thereon, and a laser scale from being affected by temperature changes. This structure provides control of extremely stable high-precision positioning of the static pressure sliding block.

The static pressure sliding block is characterized in that the linear expansion coefficient of the block body is $-3\times10^{-6}$ or more without exceeding $3\times10^{-6}$ and preferably $0.5\times10^{-6}$ or more without exceeding $3\times10^{-6}$.

With a material the linear expansion coefficient of which is $-3\times10^{-6}$ or more without exceeding $3\times10^{-6}$, a high-precision static pressure sliding block can be achieved because of a small positional variation caused by temperature change. A material which has a negative linear expansion coefficient (for example, quartz) or a small linear expansion coefficient generally tends to have strong brittleness like glass ceramics. It is, therefore, preferable that the linear expansion coefficient is $0.5\times10^{-6}$ or more without exceeding $3\times10^{-6}$ so that procurement of materials having high fracture toughness is easier.

The static pressure sliding block is further characterized in that the aforementioned sliding block body is made of ceramic. The prior art sliding block body is formed of cast iron having a linear expansion coefficient of $10\times10^{-6}$, a specific weight of 7.8 and a Young's modulus of about 130 GPa. By contrast, the ceramic has a Young's modulus of about 300 GPa, which is higher than that of cast iron. This feature reduces deformation of the sliding block body resulting from deflection and reaction force of machining, and ensures stable positioning accuracy of the tool and spindle mounted thereon. The linear expansion coefficient is much smaller than that of the prior art cast iron, and this reduces variations in position caused by temperature changes. Further, the specific weight is as small as about one third that of the prior art cast iron. This reduces the weight of the sliding block body, hence provides high-speed and high-precision feeding control.

When a ceramic material is used, it is possible to form a hole by polishing, but this work involves difficulties and requires high cost. Further, threads are easily destroyed when a great deal of force is used to tighten the threads. By contrast, in the present invention, when the flow control member is mounted on the static pressure receiving surface of the sliding block body, it can be securely mounted by only compressive stress. Especially when the sliding block body is to be formed by using a material weak under tensile force such as ceramic, the present invention provides reliable and optimum mounting of the flow control member at reduced cost.

The static pressure sliding block of the present invention is further characterized in that the aforementioned ceramic is made of silicon nitride or sialon. Silicon nitride or sialon of ceramic in particular has fracture toughness as high as 6.0, and does not break easily. It has a Young's modulus of about 290 GPa, which provides resistance to deformation. Further, the linear expansion coefficient at room temperature is as low as $1.5\times10^{-6}$, and this results in a very small expansion and shrinkage of the sliding block body due to temperature. Thus, the present invention provides a high-precision static pressure sliding block wherein the positions of a tool and workpiece mounted on the sliding block body are not affected by temperature changes. Further, the specific gravity is as low as 3.3, and hence control load such as inertia force is kept at a very low level when the sliding block is driven, and therefore higher precision feeding control can be achieved.

The static pressure sliding block is further characterized in that the linear expansion coefficient of the member forming the supporting surfaces is $-3\times10^{-6}$ or more without exceeding $3\times10^{-6}$ and preferably $0.5\times10^{-6}$ or more without exceeding $3\times10^{-6}$. The member forming the prior art supporting surfaces is commonly made of cast iron, similarly to the case of the sliding block body. For the static pressure sliding block using a gas as the pressure transmission medium, alumina ceramic is used as the member forming the supporting surfaces to ensure high precision. Here, if the sliding block body is made of a material of low linear expansion such as ceramic, the member forming the supporting surface for supporting it, is also made of a material of low linear expansion. This arrangement ensures stable traveling of the static pressure sliding block wherein the rigidity, position and feeding posture is kept constant, without the spacing of static pressure receiving surfaces being affected by ambient temperature change. The member having the supporting surface is commonly based on a lamination structure, and bolts are used to connect the parts securely into an integrated unit, thereby withstanding a large mount of static pressure force. Thus, such a metallic material as Invar, Super-Invar or Stainless Invar (trademark names of Shinhokoku Steel Co., Ltd.) is preferably used because it allows threads to be tapped directly and allows screws to be tightened firmly without being broken. When a ceramic material is used, silicon nitride or sialon is preferably used because it has a high degree of fracture toughness, and a low linear expansion coefficient. Even where the room temperature is effectively controlled, there is a temperature change of approximately ±0.5° C. If conventional cast iron is used as a material of the member forming the supporting surfaces, a variation of several microns will easily occur to the spacing of the supporting surfaces. This will cause a variation in the static pressure gap, rigidity and position of the static pressure sliding block. This will result in a failure of stable support or movement, with a high degree of reproducibility, of the tool and workpiece placed on the static pressure sliding block. Accordingly, at least the linear expansion coefficient of the member forming the supporting surfaces is preferably much less than that of the cast iron in order to ensure high-precision positioning and it is preferably approximately $3\times10^{-6}$ or less. In the meantime, a material having too small a linear expansion coefficient tends to be brittle, as exemplified by crystallized glass. Accordingly, a linear expansion coefficient of $0.5\times10^{-6}$ or more is preferably selected to provide a safe and reliable method for ensuring stable characteristics of the static pressure sliding block against temperature changes.

The static pressure sliding block of another embodiment is one supported movably by a pressure transmission medium against the first and second supporting surfaces extending in mutually crossing directions, and is composed of a sliding block body being formed of a brittle material with a pair of the first static pressure receiving surfaces as the traveling surfaces opposed to the first supporting surface communicated through the first aperture as the penetrating hole, with a pair of the second static pressure receiving surfaces opposed to the second supporting surface communicated through the second aperture, and with a medium supply hole communicating with the first and second apertures; a first flow control member equipped with a flow control portion as the overhanging member which supplies the flow rate controlled pressure transmission medium, to the space between the first supporting surface and first static pressure receiving surface; the first connecting member connected to the first flow control member, extending from one of the first static pressure receiving surfaces to the other first static pressure receiving surface through the first aperture, and mounted on the other first static pressure receiving surface; a second flow control member equipped with a flow control portion, for supplying the flow rate controlled pressure transmission medium to the space between the second supporting surface and second static pressure receiving surface and a second connecting member joining the second flow control member, extending from one of the second static pressure receiving surfaces to the other second static pressure receiving surface through the second aperture, and mounted on the other second static pressure receiving surface; wherein the first flow control member is pressed against one of the first static pressure receiving surfaces by the elastic deformation of the first connecting member, whereby the second flow control member is pressed against one of the second static pressure receiving surfaces by the elastic deformation of the second connecting member; and wherein the first connecting member and second connecting member are arranged in such a way that they will not interfere with each other.

Since the static pressure sliding block of the invention is movably supported by a pressure transmission medium with respect to the first and second supporting surfaces extending in mutually crossing directions, the first and second connecting members may interfere with each other, depending on the position of the first and second apertures. To avoid this possibility, the first and second apertures are formed at positions slightly displaced from each other. This arrangement prevents the first and second connecting members from interfering with each other. It further simplifies parts and improves the assembling efficiency. Further, an easy supply of the pressure medium is provided by formation of a medium supply path leading to the first and second apertures.

The static pressure sliding block of another embodiment is further characterized in that the first connecting member is a pipe; the first flow control members are mounted on both ends thereof, and/or the second connecting member is a pipe; the second flow control members are mounted on both ends thereof.

The static pressure sliding block is further characterized in that the pressure transmission medium is supplied through the first and second apertures.

The static pressure sliding block is characterized in that the linear expansion coefficient of the block body is $-3\times10^{-6}$ or more without exceeding $3\times10^{-6}$ and preferably $0.5\times10^{-6}$ or more without exceeding $3\times10^{-6}$.

The static pressure sliding block is further characterized in that the sliding block body is made of ceramic.

The static pressure sliding block is further characterized in that the aforementioned ceramic is silicon nitride or sialon.

The static pressure sliding block is further characterized in that the linear expansion coefficient of the member forming the supporting surface is $-3\times10^{-6}$ or more without exceeding $3\times10^{-6}$, and preferably, $0.5\times10^{-6}$ or more without exceeding $3\times10^{-6}$.

The static pressure sliding block is further characterized in that the aforementioned pressure transmission medium is a liquid. This method allows the support rigidity to be increased, as compared to the case where a gas is employed. Among liquids, oil is preferred but water can also be used.

The present invention provides a static pressure sliding block characterized by light weight and a high degree of rigidity and reliability.

The following describes the embodiment of the present invention with reference to drawings: FIG. 1 is a perspective view of five-axis machine 10 equipped with a static pressure sliding block (sliding block) of the present invention. This static pressure sliding block can be used not only as the processing machine, but also as a high-precision measuring instrument. In FIG. 1, active air mount 11 supported by four legs 11*a* (only three given in the FIG. 1) on floor F provides a means for restraining the transmission of vibration and they have a function to prevent vibration of the floor from being transmitting to base 12.

Paired slide rails 13 as members having supporting surfaces is formed on base 12 supported on active air mount 11. Static pressure sliding block 20 movable in the Z-axis direction is provided in the space between supporting surfaces 13*a* of slide rails 13 opposed to each other, and turn table 14 is rotatably mounted on static pressure sliding block 20. Via static pressure of oil used as a pressure transmission medium, static pressure sliding block 20 is supported on slide rails 13, and turn-table 14 is supported on static pressure sliding block 20.

Further, over base 12, slide table 16 is provided on rail 15*a* spanning a pair of support blocks 15, and slide table 17 movable in the Y-axis direction is provided on rail 16*a* located on slide table 16. Turn table 18 is rotatably mounted on slide table 17. Using oil as a pressure transmission medium, slide table 16 is supported by static pressure on rail 15*a*, slide table 17 is supported on rail 16*a* and turn table 18 is supported on slide table 17.

Figure 2:
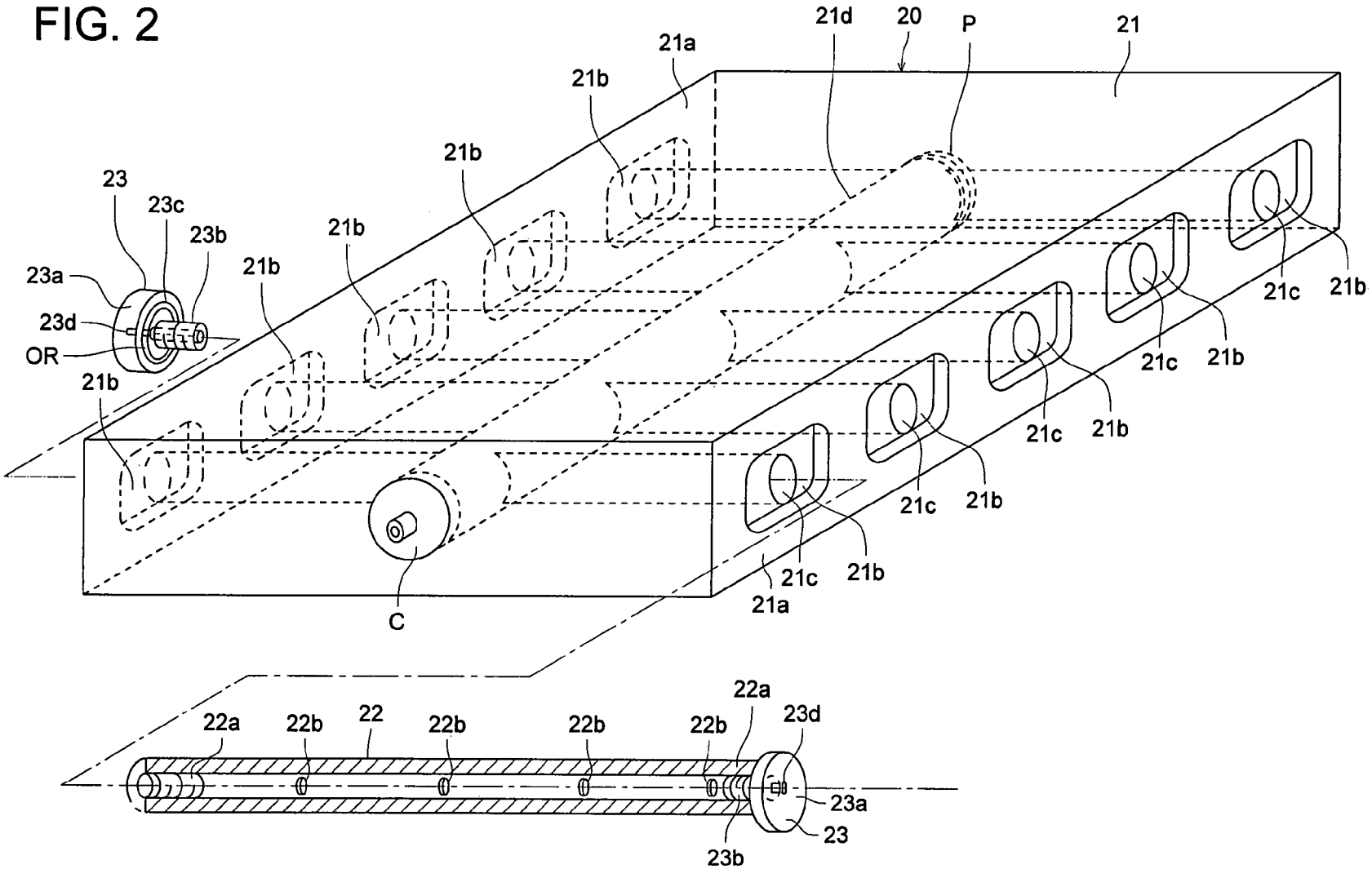
FIG. 2 is a perspective exploded view of static pressure sliding block 20 of a first embodiment.

FIG. 2 is a perspective exploded view of static pressure sliding block 20 (sliding block) of the first embodiment. In the example shown in FIG. 2, the turn table support structure is omitted for simplicity. Static pressure sliding block 20 is composed of a sliding block body 21 as the block body, a pipe 22 (also called elastic member) as the connecting member and an orifice member 23 (flow rate control member) as the overhanging member with a flow rate control portion. The sliding block body 21 composed of ceramic such as silicon nitride forms static pressure receiving surfaces 21*a* and 21*a* as the traveling surfaces. Each static pressure receiving surface 21*a* is equipped with five rectangular recesses (concave portions) 21*b* as the openings, and each recess 21*b* (first opening) has an aperture 21*c* as the penetrating hole. Aperture 21*c* as the penetrating hole leads to the counterpart recess 21*b* (second opening) formed on the opposite static pressure receiving surface 21*a*. Further, sliding block body 21 has oil supply hole 21*d* leading to each aperture 21*c*, extending in the direction crossing the same. The starting end of oil supply hole 21*d* is connected with a connector C to supply oil as the pressure transmission medium from outside. The terminating end of the oil supply hole 21*d* is blocked by cover member P. Oil supply hole 21*d* is not necessarily required to be a through-hole.

Hollow cylindrical pipe 22 as the connecting member the cross section of which is illustrated has tapped holes 22*a* as the coupling mechanisms on each end and oil inlet holes 22*b* are formed equally spaced in the longitudinal direction. Orifice member 23 is formed of head 23*a* as the overhanging portion and threaded shaft 23*b* as the coupling mechanism connected coaxially therewith. Head 23*a* has a larger diameter than aperture 21*c*, but can be incorporated in recess 21*b*. Peripheral groove 23*c* is formed on the surface around threaded shaft 23*b*. O-ring OR is arranged inside peripheral groove 23*c*. Threaded shaft 23*b* is hollow and the inner space communicates with small-diameter orifice (also called a flow control member) 23*d* formed at the center of head 23*a*.

When static pressure sliding block 20 is assembled, threaded shaft 23*b* of one orifice member 23 is screwed into tapped hole 22*a* as the coupling mechanism on one end of pipe 22 as the connecting member (as shown in FIG. 2). In this state, pipe 22 is inserted into aperture 21*c* from the end where orifice member 23 is not mounted. In parallel with it, another orifice member 23 is inserted through the opposing end of aperture 21*c*, and is screwed into the inserted end of pipe 22. As orifice member 23 is screwed into position, pipe 22 deforms and tensile stress occurs. This causes head 23*a* of orifice member 23 to be pressed against the bottom surface of recess 21*b*. In this case, O-ring OR operates to enclose the space between head 23*a* and recess 21*b*, and pipes 22 and orifice members 23 are connected to all apertures 21*c*, although not illustrated. Pipe 22 forms an elastic member.

The following describes the operation of static pressure sliding block 20 according to the present embodiment. Static pressure oil (also simply called oil) as the pressure transmission medium is supplied from an external pump (not illustrated) through connector C at 5 through 30 atm. This static pressure is distributed to apertures 21*c* through oil supply hole 21*d* of sliding block body 21*a*. The static pressure oil distributed to aperture 21*c* flows along the outer periphery of pipe 22 having a diameter smaller than that of aperture 21*c*, and enters pipe 22 through oil inlet holes 22*b*. The oil is discharged into recess 21*b* after the flow rate is controlled through orifice hole 23*d*. The static pressure oil discharged into recess 21*b* remains in a very small gap of about 10 microns between static pressure receiving surface 21*a* and supporting surface 13*a* (FIG. 1), thereby supporting them separated from each other. Since the rate of discharge is determined by orifice hole 23*d*, a high degree of supporting rigidity is ensured. Under this condition, static pressure sliding block 20 is moved by the drive force from a drive source (not illustrated) with high accuracy controlling vibration.

In the present embodiment, both orifice member 23 and pipe 22 are made of stainless steel, and the same type of orifice member 23 is mounted on each end of pipe 22. It is also possible to make such arrangements that a disk having the same shape as the head of orifice member 23 is welded to pipe 22.

In this case, only five parts, three simple machining parts plus two O-rings, are sufficient for each aperture 21*c*. This makes it possible to provide a static pressure sliding block characterized by low cost and ease of assembly procedure. Moreover, for mounting, only compressive stress is applied to brittle sliding block body 21 so there is no need of tapping a hole or tightening a screw. Accordingly, all possibility of damage is eliminated.

In the present embodiment, sliding block body 21 is made of silicon nitride ceramic. Apertures 21*c*, oil supply holes 21*d* and recesses 21*b* are structured during the stage of interim sintering of ceramic powder. Then after final sintering, static pressure receiving surfaces 21*a* are finished by plane polishing. Processing of apertures 21*c*, oil supply holes 21*d* and recesses 21*b* do not require high precision, and can be formed very easily in the stage of interim sintering. They can be processed together with the holes to be tapped for screws used to secure other parts. This method provides the advantage of requiring almost no increase in processing costs as compared to the prior art method.

In the static pressure sliding block shown in FIG. 2, the present inventors formed orifice member 23 by electro-discharge machining so that orifice member 23 had an orifice hole of diameter of 0.3 mm and a length of 5 mm. The static pressure sliding block was set on slide rails 13 shown in FIG. 1, wherein at each side a gap of 10 μm was provided between static pressure receiving surface 21*a* (dimensions on one side: 50 mm×250 mm) and supporting surfaces 13*a*. Static pressure oil was supplied at 5 atm., and static pressure rigidity was measured. The reading was not less than 1000 N/μm. The performance was the same as that when the sliding block body was manufactured using an ordinary metallic material, and the orifice member was screwed directly into the sliding block. Further, the weight of sliding block body 21 was reduced to be as much as about 40 percent, as compared to the case when normal cast iron is used to manufacture it.

Figure 3:
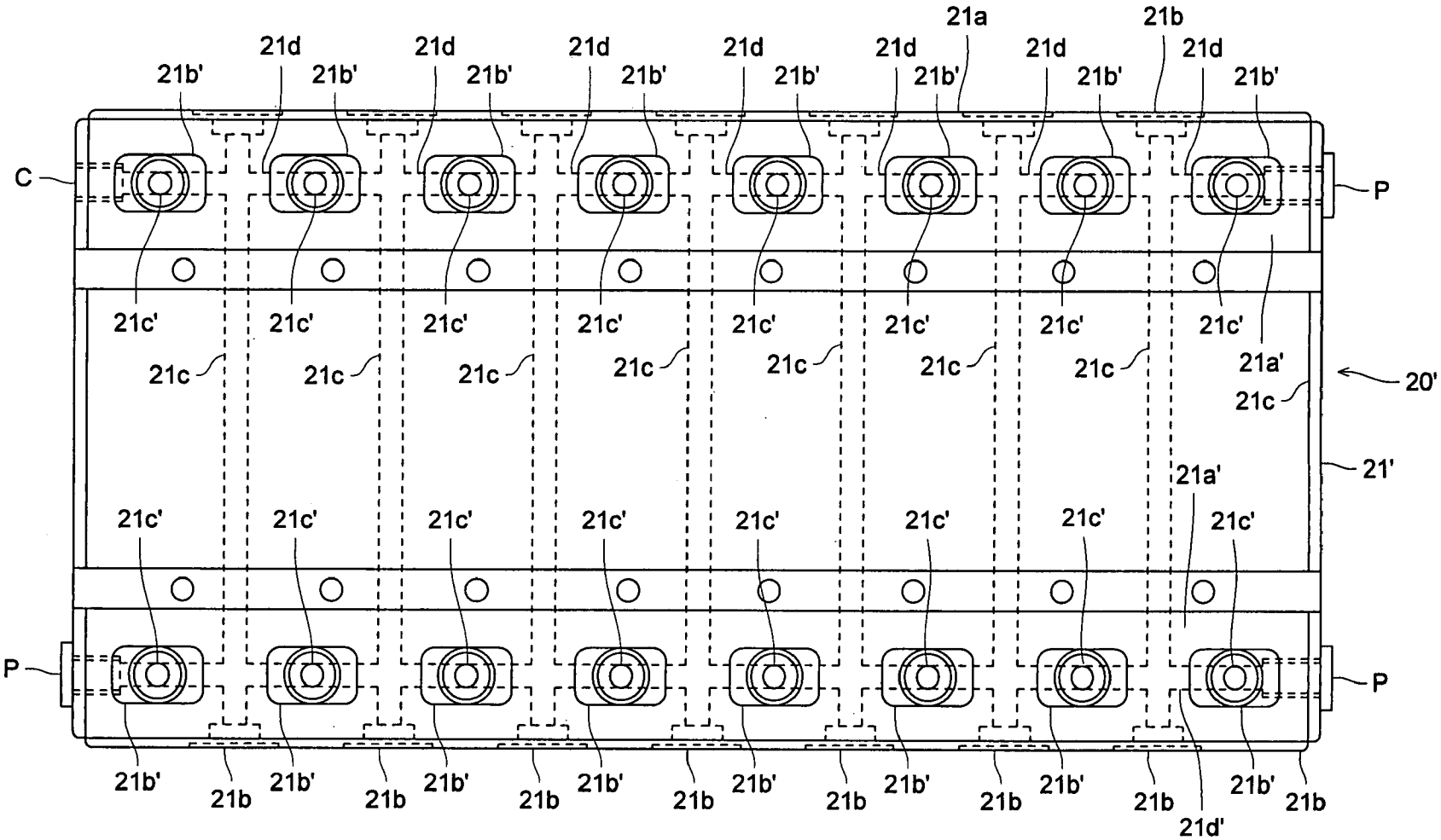
FIG. 3 is a top view of static pressure sliding block 20' of the second embodiment.

FIG. 3 is a top view of static pressure sliding block 20' of the second embodiment. The example given in FIG. 2 is a static pressure sliding block with static pressure supporting in the horizontal direction, whereas FIG. 3 is an example of achieving static pressure support in both the horizontal and vertical directions.

Similarly to the case of the aforementioned embodiment, in sliding block body 21' of static pressure sliding block 20' of the present embodiment, first static pressure receiving surfaces 21*a* on both sides are provided with first recesses 21*b*, and second static pressure receiving surfaces 21*a'* as the top and bottom surfaces are provided with two rows of second recesses 21*b'*. First recesses 21*b* opposed to each other communicate with first aperture 21*c*, and second recesses 21*b'* opposed to each other communicate with second apertures 21*c'*. As shown in FIG. 3, first apertures 21*c* and second apertures 21*c'* are displaced in the longitudinal direction of sliding block body 21'.

Oil supply holes 21*d* and 21*d'* are formed to extend from one of the end faces in the longitudinal direction of sliding block body 21' to reach the other end face in such a way as to alternately cross first apertures 21*c* and second apertures 21*c'*. Similarly to the aforementioned embodiment, one end of oil supply hole 21*d* is equipped with connector C, and the other end is provided with cover member P. Each end of oil supply hole 21*d'* is provided with cover member P. Oil supply holes 21*d* and 21*d'* communicates with each other through the first apertures 21*c*. Accordingly, the hydraulic oil supplied from connector C is distributed to every space of oil supply holes 21*d* and 21*d'*.

In the present embodiment, first apertures 21*c* are provided with pipe 22 shown in FIG. 2, and second aperture 21*c'* are equipped with a shorter version of pipe 22 shown in FIG. 2 (not illustrated). In this case, first aperture 21*c* and second aperture 21*c'* are positioned so as to avoid interference with each other. This eliminates the possibility of interference between pipes 22 inserted therein. Orifice member 23 shown in FIG. 2 is mounted on each end of pipe 22, whereby the same advantages as those of the aforementioned embodiment can be obtained. According to the present embodiment, the top and bottom surfaces as well as both sides are supported by static pressure. This arrangement provides static pressure sliding block 20' characterized by a higher degree of supporting rigidity.

Figure 4:
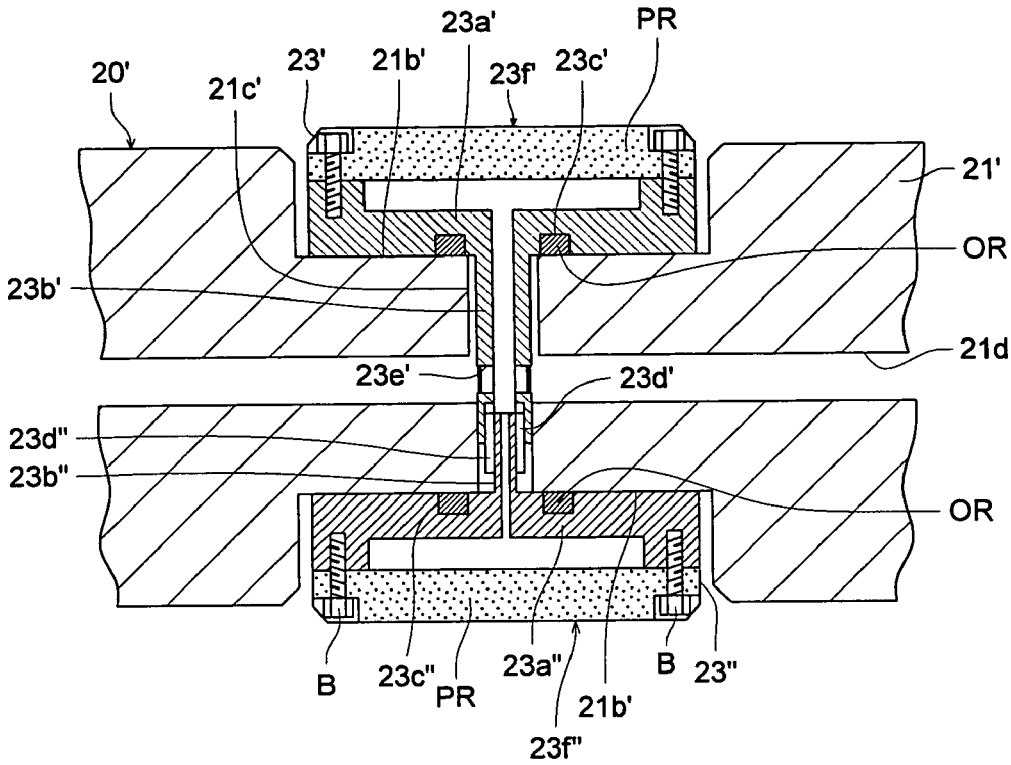
FIG. 4 is a cross sectional view of the sliding block body equipped with the flow control member as a modified example.

FIG. 4 is a cross sectional view of a sliding block body equipped with the flow control member as a modified example. For example, in the embodiment shown in FIG. 3, aperture 21*c'* communicating with the top and bottom surfaces of sliding block body 21' has a smaller overall length, and hence the pipe to be inserted is also short. When the pipe is considered as part of the flow control member, this arrangement further reduces the number of parts.

More specifically, flow control members 23' and 23" of different configuration are used. Flow control members 23' is composed of disk-formed head 23*a'* having an empty space inside, hollow long shaft 23*b'* and female screw 23*d'*. Disk-formed porous member PR is arranged on the tip end of head 23*a'* so as to block the internal space, and is secured by bolt B. Peripheral groove 23*c'* is formed on the surface of head 23*a'* opposed to recess 21*b'*, and O-ring OR is arranged there. Peripheral groove 23*c'* is formed on the surface opposed to recess 21*b'* of head 23*a'*. Further, long shaft 23*b'* has oil inlet path 23*e'* formed at the position corresponding to oil supply hole 21*d*, where oil inlet path 23*e'* communicates with the inside.

In the meantime, orifice member 23" is composed of disk-formed head 23*a"* having an empty space inside, hollow short shaft 23*b"* and male screw 23*d"* formed at the tip end of short shaft 23*b"*. Disk-formed porous member PR is arranged on the tip end of head 23*a"* so as to block the internal space, and is secured by bolt B. Peripheral groove 23*c"* is formed on the surface of head 23*a"* opposed to recess 21*b'*, and O-ring OR is arranged there.

At the time of assembling, long shaft 23*b'* of first flow control member 23' and long shaft 23*b'* of second flow control member 23" are inserted from both ends of aperture 21*c'*, and male screw 23*d"* is engaged with female screw section 23*d'* (FIG. 4). Then elastic deformation occurs to long shaft 23*b'* and short shaft 23*b"*, and tensile stress is produced. This causes heads 23*a'* and 23*a"* of flow control members 23' and 23" to be pressed against the bottom of recesses 21*b* and 21*b*. In this case, O-rings OR and OR operate to enclose the space between head 23*a'* and recess 21*b* and between 23*a"* and recess 21*b*. Long shaft 23*b'* and short shaft 23*b"* constitute the elastic member. Regardless of the aforementioned structure, first flow control member 23' and second flow control member 23" may be connected by a spring (elastic body) extending in aperture 21*c'*.

Static pressure oil having a pressure of about 5 through 30 atm. is supplied from the external pump (not illustrated) through connector C. Then this static pressure oil is fed to aperture 21*c'* through oil supply hole 21*d* of sliding block body 21'. The static pressure oil fed to aperture 21*c'* goes into long shaft 23*b'* and short shaft 23*b"* through oil inlet path 23*e'*, and is discharged from the space inside heads 23*a'* and 23*a"*. The static pressure oil can be supplied from this space to static pressure receiving surfaces 23*f'* and 23*f"* structured of the surface of porous member PR at a uniform pressure through a countless number of minute holes on porous members PR as flow control members, after the flow rate has been controlled.

Figure 5:
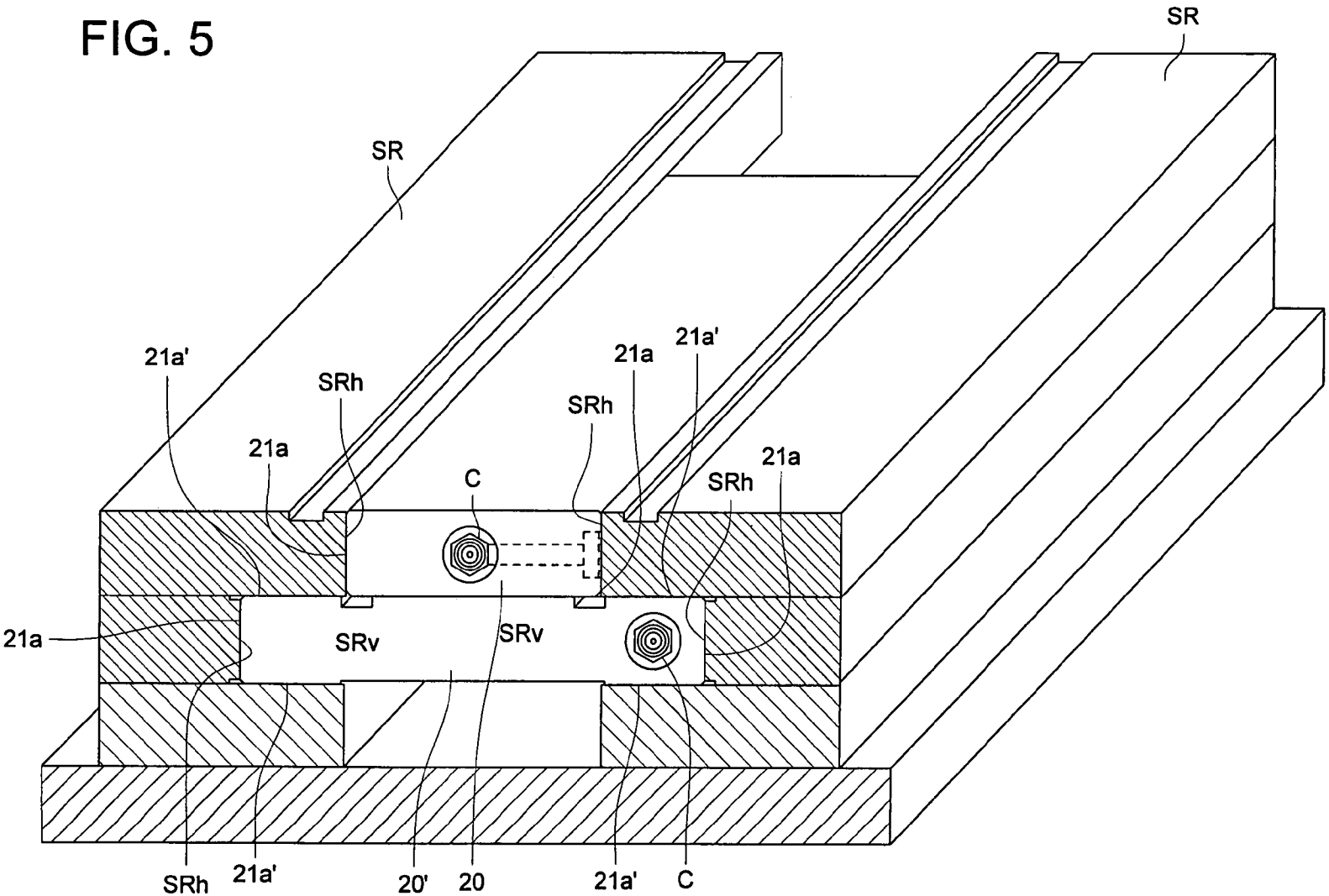
FIG. 5 is a perspective view of an example of static pressure sliding block 20 shown in FIG. 2 and static pressure sliding block 20' shown in FIG. 3 assembled in two layers.

FIG. 5 is a perspective view of an example of static pressure sliding block 20 shown in FIG. 2 and static pressure sliding block 20' shown in FIG. 3 assembled in two layers. These static pressure sliding blocks were installed, wherein the gap between the horizontal support surface (first support surface) SRh of the slide rail SR made of super-invar and first static pressure receiving surface 21*a* of static pressure sliding blocks 20 and 20', and the gap between the vertical support surface (second support surface) SRv and second static pressure receiving surface 21*a'* were provided 5 μm on each side. The main body of static pressure sliding blocks 20 and 20' is made of sialon. The static pressure receiving surface is configured in such a way that the horizontal receiving surface has the dimensions of 50 mm×540 mm (with seven recesses) on one side, and the vertical receiving surface the dimensions of 60 mm×540 mm (with eight recesses) on one side. Water is used as a pressure transmission medium and is supplied to static pressure sliding blocks 20 and 20' at a pressure of 5 atm through connector C.

The static rigidity of this structure is 2580 N/μm or more in the horizontal direction and 2800 N/μm or more in the vertical direction and an extremely high degree of rigidity has been achieved. Even when exposed to the force of this magnitude, static pressure sliding blocks 20 and 20' are free from deformation. Even if the static pressure gap is as small as 5 μm, smooth traveling is carried out over a stroke of 250 mm without any mechanical contact at all. Further, the weight of static pressure sliding blocks 20 and 20' is about 40% that of a normal cast iron material. Use of sialon has reduced the weight by 51 kg.

A linear motor (not illustrated) was mounted on static pressure sliding blocks 20 and 20' of the present embodiment, and were driven for a very small displacement of the level of 1 nm. The overshoot did not exceed 3 nm which was within the tolerance, and the difference (tracking error) between the command value and actual slide position during the movement at a constant speed of 10 mm/min. did not exceed 12 nm. Therefore, a high-precision feeding with a high degree of reproducibility has been achieved.

In FIGS. 6(*a*), 6(*b*) and 6(*c*), modified examples of the assembly structure of an orifice member as the flow control member and a connecting shaft as the connecting member.

FIG. 6(*a*) is an example in which one orifice member (flow control member) as the overhanging member with a flow control portion is installed on one end of a connecting member which is formed of a solid shaft. Orifice member 24 is formed of head 24*a* as the overhanging portion and threaded shaft 24*b* as the coupling mechanism connected coaxially therewith. Head 24*a* has a larger diameter than aperture 21*c*" as the penetrating hole, but can be incorporated in recess 21*b*" as the opening. Peripheral groove 24*c* is formed on the surface around threaded shaft 24*b*. O-ring OR is arranged inside peripheral groove 24*c*. Threaded shaft 24*b* has a side hole 24*e* and the inner space communicates with small-diameter orifice (also called a flow control portion) 24*d* formed at the center of head 24*a*. Connecting shaft 25 as the solid connecting member with overhanging portion 25*a* the cross section of which is illustrated has peripheral groove 25*c* on overhanging portion 25*a*. O-ring OR is arranged inside peripheral groove 25*c* and connecting shaft 25 is coupled with orifice member 24 with threaded shaft 24*b* and threaded hole 25*b* as the coupling mechanisms.

FIGS. 6(*b*) and 6(*c*) are examples of a solid shaft with flow control members as the overhanging member on both sides. FIG. 6(*b*) is especially an example in which one flow control member is integrated with the solid shaft as one piece and the number of parts is reduced. It includes orifice member 24 the same as in FIG. 6(*a*) and solid connecting shaft 25' with side hole 25*e* and small-diameter orifice 25*d* formed at the center of head 25*a*' and coupled with orifice member 24 with coupling of threaded shaft 24*b* and threaded hole 25*b*' as the coupling mechanisms. FIG. 6(*c*) is an example in which both orifice member 24 as the flow control members are screwed into the solid shaft. Orifice members 24 the same as in FIGS. 6(*a*) and 6(*b*) are coupled with solid connecting shaft 25" with threaded holes 25*b*" by coupling of threaded shafts 24*b* and threaded holes 25*b*". The detailed configuration of the present embodiment can be appropriately modified, without departing from the spirit of the present invention.

What is claimed is:

1. A sliding block supported movably by static pressure of a pressure transmission medium between a pair of supporting surfaces comprising:

a block body comprising a first traveling surface and a second traveling surface each opposed to the supporting surfaces to travel, a first opening and a second opening formed on the first traveling surface and the second traveling surface respectively, a penetrating hole which is smaller than the first opening and the second opening, and communicates with respective bottom surfaces of the first opening and the second opening, and a first overhanging member and a second overhanging member which are located in the first opening and the second opening respectively and each has an overhanging portion larger than the penetrating hole;

a connecting member located in the penetrating hole, to connect the first overhanging member and the second overhanging member;

wherein at least one of the first overhanging member and the second overhanging member has a coupling mechanism to be detachable from the connecting member, and the first overhanging member and the second overhanging member are fixed while pressing the bottom surfaces of the first opening and the second opening respectively through the connecting member by means of the coupling mechanism; and a flow control portion provided to at least one of the first overhanging member and the second overhanging member, to discharge the pressure transmission medium supplied into the penetrating hole and to control a flow rate of the pressure transmission medium.

2. The sliding block of claim 1, wherein the coupling mechanism is provided between the first overhanging member and the connecting member and the second overhanging member is integrated with the connecting member as one piece.

3. The sliding block of claim 1, wherein the coupling mechanism is provided each between the first overhanging member and the connecting member and between the second overhanging member and the connecting member.

4. The sliding block of claim 1, wherein a flow control portion is provided to each of the first overhanging member and the second overhanging member.

5. The sliding block of claim 1, wherein the connecting member is a hollow pipe.

6. The sliding block of claim 1, further comprising:

plural pairs of first openings and second openings, penetrating holes, first overhanging members and second overhanging members, connecting members, coupling mechanisms and flow control portions.

7. The sliding block of claim 1, wherein the block body comprises third traveling surface extending in a direction crossing extending directions of the first traveling surface and the second traveling surface, and a fourth surface paired with the third traveling surface and wherein the sliding block further comprises a third opening and a fourth opening, a penetrating hole, a third overhanging member and a fourth overhanging member, a connecting member, a coupling mechanism and a flow control portion to discharge the pressure transmission medium to the third traveling surface.

8. The sliding block of claim 1, wherein a linear expansion coefficient of the block body is $-3\times10^{-6}$ or more without exceeding $3\times10^{-6}$.

9. The sliding block of claim 1, wherein a linear expansion coefficient of the block body is $0.5\times10^{-6}$ or more without exceeding $3\times10^{-6}$.

10. The sliding block of claim 1, wherein the block body is made of ceramic.

11. The sliding block of claim 8, wherein the ceramic is made of silicon nitride or sialon.

12. The sliding block of claim 1, wherein a linear expansion coefficient of members forming the supporting surfaces is $-3\times10^{-6}$ or more without exceeding $3\times10^{-6}$.

13. The sliding block of claim 12, wherein the linear expansion coefficient is $0.5\times10^{-6}$ or more without exceeding $3\times10^{-6}$.

14. The sliding block of claim 1, wherein the pressure transmission medium is liquid.

15. The sliding block of claim 1, wherein the first overhanging member and the second overhanging member each protrude from the first traveling surface and the second traveling surface and have a function as a sliding surface.

* * * * *